US010304387B2

(12) United States Patent
Chen

(10) Patent No.: US 10,304,387 B2
(45) Date of Patent: May 28, 2019

(54) AMOLED PIXEL DRIVING CIRCUIT AND AMOLED PIXEL DRIVING METHOD

(71) Applicant: Shenzhen China Star Optoelectronics Semiconductor Display Technology Co., Ltd., Shenzhen (CN)

(72) Inventor: Xiaolong Chen, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/578,260

(22) PCT Filed: Nov. 29, 2017

(86) PCT No.: PCT/CN2017/113621
§ 371 (c)(1),
(2) Date: Nov. 30, 2017

(87) PCT Pub. No.: WO2019/010900
PCT Pub. Date: Jan. 17, 2019

(65) Prior Publication Data

US 2019/0019456 A1 Jan. 17, 2019

(51) Int. Cl.
*G09G 3/32* (2016.01)
*G09G 3/3258* (2016.01)

(52) U.S. Cl.
CPC ... *G09G 3/3258* (2013.01); *G09G 2300/0819* (2013.01); *G09G 2310/08* (2013.01); *G09G 2320/0233* (2013.01); *G09G 2320/045* (2013.01)

(58) Field of Classification Search
None
See application file for complete search history.

(56) References Cited

U.S. PATENT DOCUMENTS

2003/0112205 A1* 6/2003 Yamada ..... G09G 3/3233 345/32
2014/0117862 A1* 5/2014 Qing ..... G09G 3/30 315/172
2016/0133187 A1* 5/2016 Li ..... G09G 3/3233 345/690
2016/0307502 A1 10/2016 Nie

FOREIGN PATENT DOCUMENTS

CN 104658483 A 5/2015
CN 106504702 A 3/2017

* cited by examiner

*Primary Examiner* — Joseph R Haley
(74) *Attorney, Agent, or Firm* — Mark M. Friedman

(57) ABSTRACT

An AMOLED pixel driving circuit and an AMOLED pixel driving method are provided. The AMOLED pixel driving circuit utilizes a 6T1C circuit in conjunction with a simple driving timing. A threshold voltage of a driving transistor can be effectively compensated, so that a current flowing through an organic light emitting device is not affected by the threshold voltage. Display uniformity of a panel can be increased. Furthermore, the structure of the AMOLED pixel driving circuit is simplified, and benefit is increased.

12 Claims, 6 Drawing Sheets

AMOLED PIXEL DRIVING CIRCUIT AND AMOLED PIXEL DRIVING METHOD

BACKGROUND

Field

The present disclosure relates to a technological field of displays, and more particularly to an AMOLED pixel driving circuit and an AMOLED pixel driving method.

Background

A current drives thin film transistors (TFTs) to be in a saturation state, so that an active matrix organic light emitting diode (AMOLED) can emit light. A 2T1C driving circuit often serves as a conventional AMOLED driving circuit. Please refer to FIG. 1. The 2T1C driving circuit includes two TFTs and a capacitor. T1 is a driving transistor of a pixel. T2 is a switching transistor. A gate line Gate turns on the switching transistor T2. A data voltage Data charges and discharges a storage capacitor Cst. The switching transistor T2 is turned off during a light emitting duration. A voltage stored in the storage capacitor Cst makes the driving transistor T1 remain in a turned-on state, and a conducting current drives the AMOLED to emit light. The current passing through the AMOLED should be stable to implement a stable display. However, since a manufacturing process is limited, a threshold voltage for driving the driving transistor T1 is not uniform and drifting. Accordingly, different driving currents are generated when gray level voltages are the same. When the driving currents are not uniform, a working state of a light emitting device is not stable. Furthermore, the deterioration of the light emitting device increases a turned-on voltage. As such, brightness of a panel is not uniform and light emitting efficiency is not high.

An improvement is disclosed to solve the above-mentioned problem in the prior art. By adding a new TFT or signal, effect resulted from the drifting threshold voltage can be weakened or canceled. However, a circuit after the improvement requires many TFTs, data control lines, and power sources, and a control timing is more complicated, so that cost is increased.

Consequently, there is a need to provide an AMOLED pixel driving circuit and an AMOLED pixel driving method to solve the above-mentioned problems in the prior art.

SUMMARY OF THE DISCLOSURE

An objective of the present disclosure is to provide an AMOLED pixel driving circuit and an AMOLED pixel driving method to solve the problem that the conventional driving circuit is complicated and to eliminate an effect of a threshold voltage of a driving transistor on a driving current.

To achieve the above-mentioned objective, the AMOLED pixel driving circuit provided by the present disclosure utilizes the following technical scheme.

An AMOLED pixel driving circuit, comprising a first thin film transistor, a second thin film transistor, a third thin film transistor, a fourth thin film transistor, a fifth thin film transistor, a sixth thin film transistor, a capacitor, and an organic light emitting diode, A gate of the first thin film transistor is electrically coupled to a first node, a source of the first thin film transistor is electrically coupled to a second node, and a drain of the first thin film transistor is electrically coupled to a second node;

A second scanning signal is inputted to a gate of the second thin film transistor, a source of the second thin film transistor is electrically coupled to the third node, and a drain of the second thin film transistor is electrically coupled to the first node;

A third scanning signal is inputted to a gate of the third thin film transistor, a source of the third thin film transistor is electrically coupled to a cathode of the organic light emitting diode, and a drain of the third thin film transistor is electrically coupled to the third node;

The second scanning signal is inputted to a gate of the fourth thin film transistor, a positive voltage of a power source is inputted to a source of the fourth thin film transistor, and a drain of the fourth thin film transistor is electrically coupled to the cathode of the organic light emitting diode;

A first scanning signal is inputted to a gate of the fifth thin film transistor, a data signal is inputted to a source of the fifth thin film transistor, and a drain of the fifth thin film transistor is electrically coupled to the second node;

A fourth scanning signal is inputted to a gate of the sixth thin film transistor, a negative voltage of the power source is inputted to a source of the sixth thin film transistor, and a drain of the sixth thin film transistor is electrically coupled to the second node;

One terminal of the capacitor is electrically coupled to the first node, and the other terminal of the capacitor is electrically coupled to a ground;

The positive voltage of the power source is inputted to an anode of the organic light emitting diode, and the cathode of the organic light emitting diode is electrically coupled to the drain of the fourth thin film transistor and the source of the third thin film transistor;

The first scanning signal, the second scanning signal, the third scanning signal, and the fourth scanning signal are provided by an external timing controller, The first scanning signal, the second scanning signal, the third scanning signal, and the fourth scanning signal are combined to correspond to a voltage initialization stage, a voltage storage stage, and a light emitting display stage.

In the AMOLED pixel driving circuit of the present disclosure, the first thin film transistor, the second thin film transistor, the third thin film transistor, the fourth thin film transistor, the fifth thin film transistor, and the sixth thin film transistor are low temperature poly-silicon thin film transistors, oxide semiconductor thin film transistors, or amorphous silicon thin film transistors.

In the AMOLED pixel driving circuit of the present disclosure, the first thin film transistor, the second thin film transistor, the third thin film transistor, the fourth thin film transistor, the fifth thin film transistor, and the sixth thin film transistor are N-type thin film transistors, In the voltage initialization stage, the first scanning signal provides a low level, the second scanning signal provides a high level, the third scanning signal provides a high level, and the fourth scanning signal provides a low level;

In the voltage storage stage, the first scanning signal provides a high level, the second scanning signal provides a high level, the third scanning signal provides a low level, and the fourth scanning signal provides a low level;

In the light emitting display stage, the first scanning signal provides a low level, the second scanning signal provides a low level, the third scanning signal provides a high level, and the fourth scanning signal provides a high level.

To achieve the above-mentioned objective, the AMOLED pixel driving circuit provided by the present disclosure further utilizes the following technical scheme.

An AMOLED pixel driving circuit, comprising a first thin film transistor, a second thin film transistor, a third thin film transistor, a fourth thin film transistor, a fifth thin film transistor, a sixth thin film transistor, a capacitor, and an organic light emitting diode, A gate of the first thin film transistor is electrically coupled to a first node, a source of the first thin film transistor is electrically coupled to a second node, and a drain of the first thin film transistor is electrically coupled to a second node;

A second scanning signal is inputted to a gate of the second thin film transistor, a source of the second thin film transistor is electrically coupled to the third node, and a drain of the second thin film transistor is electrically coupled to the first node;

A third scanning signal is inputted to a gate of the third thin film transistor, a source of the third thin film transistor is electrically coupled to a cathode of the organic light emitting diode, and a drain of the third thin film transistor is electrically coupled to the third node;

The second scanning signal is inputted to a gate of the fourth thin film transistor, a positive voltage of a power source is inputted to a source of the fourth thin film transistor, and a drain of the fourth thin film transistor is electrically coupled to the cathode of the organic light emitting diode;

A first scanning signal is inputted to a gate of the fifth thin film transistor, a data signal is inputted to a source of the fifth thin film transistor, and a drain of the fifth thin film transistor is electrically coupled to the second node;

A fourth scanning signal is inputted to a gate of the sixth thin film transistor, a negative voltage of the power source is inputted to a source of the sixth thin film transistor, and a drain of the sixth thin film transistor is electrically coupled to the second node;

One terminal of the capacitor is electrically coupled to the first node, and the other terminal of the capacitor is electrically coupled to a ground;

The positive voltage of the power source is inputted to an anode of the organic light emitting diode, and the cathode of the organic light emitting diode is electrically coupled to the drain of the fourth thin film transistor and the source of the third thin film transistor.

In the AMOLED pixel driving circuit of the present disclosure, the first scanning signal, the second scanning signal, the third scanning signal, and the fourth scanning signal are provided by an external timing controller.

In the AMOLED pixel driving circuit of the present disclosure, the first thin film transistor, the second thin film transistor, the third thin film transistor, the fourth thin film transistor, the fifth thin film transistor, and the sixth thin film transistor are low temperature poly-silicon thin film transistors, oxide semiconductor thin film transistors, or amorphous silicon thin film transistors.

In the AMOLED pixel driving circuit of the present disclosure, the first scanning signal, the second scanning signal, the third scanning signal, and the fourth scanning signal are combined to correspond to a voltage initialization stage, a voltage storage stage, and a light emitting display stage.

In the AMOLED pixel driving circuit of the present disclosure, the first thin film transistor, the second thin film transistor, the third thin film transistor, the fourth thin film transistor, the fifth thin film transistor, and the sixth thin film transistor are N-type thin film transistors, In the voltage initialization stage, the first scanning signal provides a low level, the second scanning signal provides a high level, the third scanning signal provides a high level, and the fourth scanning signal provides a low level;

In the voltage storage stage, the first scanning signal provides a high level, the second scanning signal provides a high level, the third scanning signal provides a low level, and the fourth scanning signal provides a low level;

In the light emitting display stage, the first scanning signal provides a low level, the second scanning signal provides a low level, the third scanning signal provides a high level, and the fourth scanning signal provides a high level.

The present disclosure further provides an AMOLED pixel driving method. A technical scheme is described as follows.

In step 1, providing an AMOLED pixel driving circuit,

The AMOLED pixel driving circuit comprises a first thin film transistor, a second thin film transistor, a third thin film transistor, a fourth thin film transistor, a fifth thin film transistor, a sixth thin film transistor, a capacitor, and an organic light emitting diode, A gate of the first thin film transistor is electrically coupled to a first node, a source of the first thin film transistor is electrically coupled to a second node, and a drain of the first thin film transistor is electrically coupled to a second node;

A second scanning signal is inputted to a gate of the second thin film transistor, a source of the second thin film transistor is electrically coupled to the third node, and a drain of the second thin film transistor is electrically coupled to the first node;

A third scanning signal is inputted to a gate of the third thin film transistor, a source of the third thin film transistor is electrically coupled to a cathode of the organic light emitting diode, and a drain of the third thin film transistor is electrically coupled to the third node;

The second scanning signal is inputted to a gate of the fourth thin film transistor, a positive voltage of a power source is inputted to a source of the fourth thin film transistor, and a drain of the fourth thin film transistor is electrically coupled to the cathode of the organic light emitting diode;

A first scanning signal is inputted to a gate of the fifth thin film transistor, a data signal is inputted to a source of the fifth thin film transistor, and a drain of the fifth thin film transistor is electrically coupled to the second node;

A fourth scanning signal is inputted to a gate of the sixth thin film transistor, a negative voltage of the power source is inputted to a source of the sixth thin film transistor, and a drain of the sixth thin film transistor is electrically coupled to the second node;

One terminal of the capacitor is electrically coupled to the first node, and the other terminal of the capacitor is electrically coupled to a ground;

The positive voltage of the power source is inputted to an anode of the organic light emitting diode, and the cathode of the organic light emitting diode is electrically coupled to the drain of the fourth thin film transistor and the source of the third thin film transistor, In step 2, performing a voltage initialization stage, The first scanning signal controls the fifth thin film transistor to be turned off, the second scanning signal controls the second thin film transistor and the fourth thin film transistor to be turned on, the third scanning signal controls the third thin film transistor to be turned on, the fourth scanning signal controls the sixth thin film transistor to be turned off, the positive voltage of the power source is written to the first node and stored in the capacitor, and the organic light emitting diode does not emit light;

In step 3, performing a voltage storage stage,

The first scanning signal controls the fifth thin film transistor to be turned on, the second scanning signal controls the second thin film transistor and the fourth thin film transistor to be turned on, the third scanning signal controls the third thin film transistor to be turned off, the fourth scanning signal controls the sixth thin film transistor to be turned off, the data signal provides a display data voltage, the data signal is written to the second node, the capacitor is discharged, so that a voltage of the first node is equal to a sum of a voltage of the second node and a threshold voltage of the first thin film transistor, the voltage of the first node is stored in the capacitor, and the organic light emitting diode does not emit light;

In step 4, performing a light emitting display stage,

The first scanning signal controls the fifth thin film transistor to be turned off, the second scanning signal controls the second thin film transistor and the fourth thin film transistor to be turned off, the third scanning signal controls the third thin film transistor to be turned on, the fourth scanning signal controls the sixth thin film transistor to be turned on, the voltage of the first node is kept at a sum of the data signal and the threshold voltage of the first thin film transistor by the capacitor, the negative voltage of the power source is written to the second node, the first thin film transistor is turned on, and the organic light emitting diode emits light.

In the AMOLED pixel driving method of the present disclosure, the first scanning signal, the second scanning signal, the third scanning signal, and the fourth scanning signal are provided by an external timing controller.

In the AMOLED pixel driving method of the present disclosure, the first thin film transistor, the second thin film transistor, the third thin film transistor, the fourth thin film transistor, the fifth thin film transistor, and the sixth thin film transistor are N-type thin film transistors.

In the AMOLED pixel driving method of the present disclosure, the first thin film transistor, the second thin film transistor, the third thin film transistor, the fourth thin film transistor, the fifth thin film transistor, and the sixth thin film transistor are N-type thin film transistors, In the voltage initialization stage, the first scanning signal provides a low level, the second scanning signal provides a high level, the third scanning signal provides a high level, and the fourth scanning signal provides a low level;

In the voltage storage stage, the first scanning signal provides a high level, the second scanning signal provides a high level, the third scanning signal provides a low level, and the fourth scanning signal provides a low level;

In the light emitting display stage, the first scanning signal provides a low level, the second scanning signal provides a low level, the third scanning signal provides a high level, and the fourth scanning signal provides a high level.

The AMOLED pixel driving circuit and the AMOLED pixel driving method provided by the present disclosure utilizes the 6T1C circuit in conjunction with a simple driving timing. An extra power source is not required, and control signals are fewer. As such, the threshold voltage of the driving transistor can be effectively compensated, so that the current flowing through the organic light emitting device is not affected by the threshold voltage. The effect of deterioration of the organic light emitting device on display brightness can be eliminated, and display uniformity of a panel can be increased. Furthermore, the structure of the AMOLED pixel driving circuit is simplified, and cost is decreased significantly.

For better understanding of the aforementioned content of the present disclosure, preferable embodiments are illustrated in accordance with the attached drawings for further explanation.

BRIEF DESCRIPTION OF THE DRAWINGS

The technical solutions, as well as beneficial advantages, of the present disclosure will be apparent from the following detailed description of embodiments of the present disclosure, with reference to the attached drawings.

DETAILED DESCRIPTION OF THE PREFERRED EMBODIMENTS

To describe the technical solutions and effect of the present disclosure more clearly, a clear and complete description will be given below, in conjunction with the accompanying drawings in the embodiments of the present disclosure. Apparently, the embodiments described below are merely a part, but not all, of the embodiments of the present disclosure. All of other embodiments, obtained by those skilled in the art based on the embodiments of the present disclosure without any inventive efforts, fall into the protection scope of the present disclosure.

Figure 1:
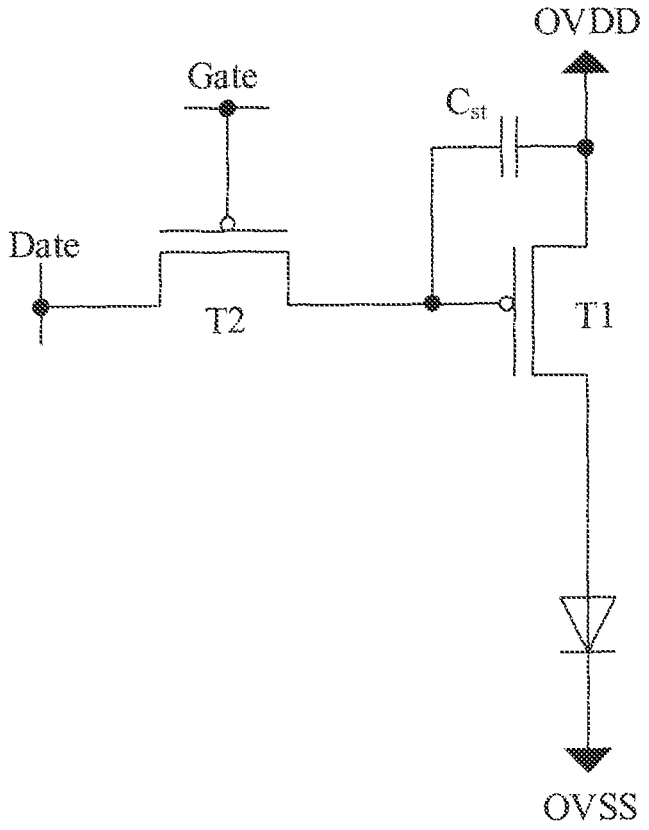
FIG. 1 (PRIOR ART)
FIG. 1 illustrates a circuit diagram of a conventional AMOLED driving circuit having a 2T1C structure.
Figure 2:
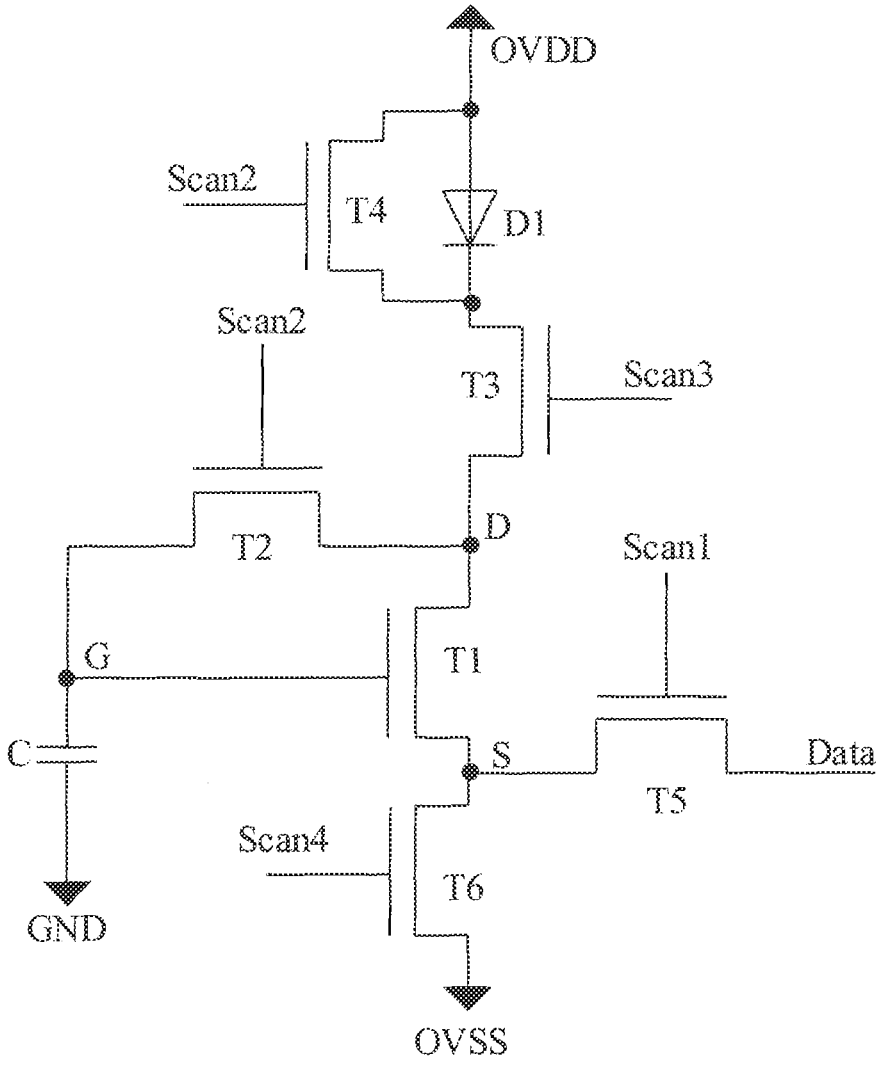
FIG. 2 illustrates a circuit diagram of an AMOLED driving circuit in accordance with the present disclosure.

Please refer to FIG. 2. The present disclosure provides an AMOLED pixel driving circuit. The AMOLED pixel driving circuit utilizes a 6T1C structure and includes a first thin film transistor T1, a second thin film transistor T2, a third thin film transistor T3, a fourth thin film transistor T4, a fifth thin film transistor T5, a sixth thin film transistor T6, a capacitor C, and an organic light emitting diode D1.

A gate of the first thin film transistor T1 is electrically coupled to a first node G A source of the first thin film transistor T1 is electrically coupled to a second node S. A drain of the first thin film transistor T1 is electrically coupled to a second node D. A second scanning signal Scan2 is inputted to a gate of the second thin film transistor T2. A source of the second thin film transistor T2 is electrically coupled to the third node D. A drain of the second thin film transistor T2 is electrically coupled to the first node G A third scanning signal Scan3 is inputted to a gate of the third thin film transistor T3. A source of the third thin film transistor T3 is electrically coupled to a cathode of the organic light emitting diode D1. A drain of the third thin film transistor T3 is electrically coupled to the third node D. The second scanning signal Scan2 is inputted to a gate of the fourth thin film transistor T4. A positive voltage OVDD of a power source is inputted to a source of the fourth thin film transistor T4. A drain of the fourth thin film transistor T4 is electrically coupled to the cathode of the organic light emitting diode D1. A first scanning signal Scan1 is inputted to a gate of the fifth thin film transistor T5. A data signal Data is inputted to a source of the fifth thin film transistor T5. A drain of the fifth thin film transistor T5 is electrically coupled to the second node S. A fourth scanning signal Scan4 is inputted to a gate of the sixth thin film transistor T6. A negative voltage OVSS of the power source is inputted to a source of the sixth thin film transistor T6. A drain of the sixth thin film transistor T6 is electrically coupled to the second node S. One terminal of the capacitor C is electrically coupled to the first node G The other terminal of the capacitor C is electrically coupled to a ground G The positive voltage OVDD of the power source is inputted to an anode of the organic light emitting diode D1. The cathode of the organic light emitting diode D1 is electrically coupled to the drain of the fourth thin film transistor T4 and the source of the third thin film transistor T3.

The first scanning signal Scan1 controls the fifth thin film transistor T5 to be turned on or turned off. The second scanning signal Scan2 controls the second thin film transistor T2 and the fourth thin film transistor T4 to be turned on or turned off. The third scanning signal Scan3 controls the third thin film transistor T3 to be turned on or turned off. The fourth scanning signal Scan4 controls the sixth thin film transistor T6 to be turned on or turned off. The data signal Data is configured to control brightness of the organic light emitting diode D1. The capacitor C is a storage capacitor. Further, turning on the second thin film transistor T2 controls the first thin film transistor T1 to be a short circuit diode to compensate a threshold voltage. In the present embodiment, the organic light emitting diode D1 is a top-emitting organic light emitting diode. That is, the anode of the organic light emitting diode D1 is directly coupled to the positive voltage OVDD of the power source. Certainly, the organic light emitting diode D1 may be a bottom-emitting organic light emitting diode. That is, the cathode of the organic light emitting diode D1 is directly coupled to the negative voltage OVSS of the power source. Compared with the bottom-emitting light emitting diode, the top-emitting light emitting diode has a high aperture ratio and better performance.

In detail, the first thin film transistor T1, the second thin film transistor T2, the third thin film transistor T3, the fourth thin film transistor T4, the fifth thin film transistor T5, and the sixth thin film transistor T6 may be low temperature poly-silicon thin film transistors, oxide semiconductor thin film transistors, or amorphous silicon thin film transistors. In the present preferred embodiment, the above-mentioned six thin film transistors are N-type thin film transistors to facilitate the structure of the circuit.

In detail, the first scanning signal Scan1, the second scanning signal Scan2, the third scanning signal Scan3, and the fourth scanning signal Scan4 are provided by an external timing controller.

Figure 3:
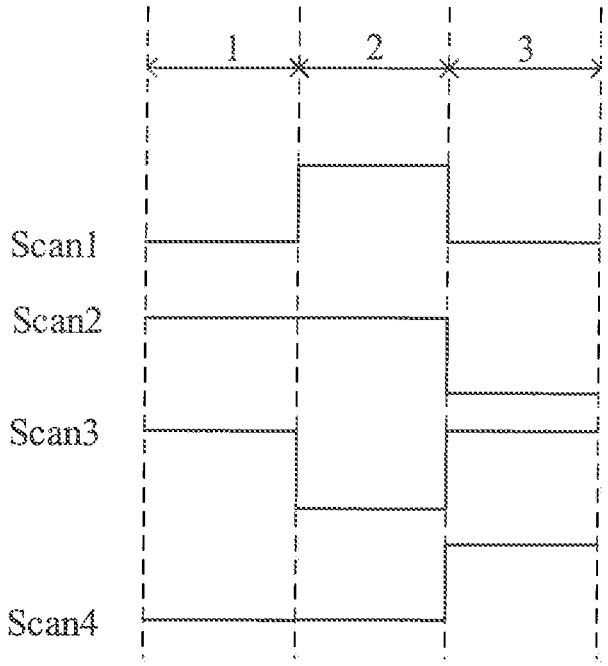
FIG. 3 illustrates a timing diagram of the pixel driving circuit in accordance with the present disclosure.

FIG. 3 illustrates a timing diagram of the scanning signals in the pixel driving circuit in accordance with an embodiment of the present disclosure. Please refer to FIG. 2 and FIG. 3. The first scanning signal Scan1, the second scanning signal Scan2, the third scanning signal Scan3, and the fourth scanning signal Scan4 are combined to correspond to a voltage initialization stage 1, a voltage storage stage 2, and a light emitting display stage 3.

Figure 4:
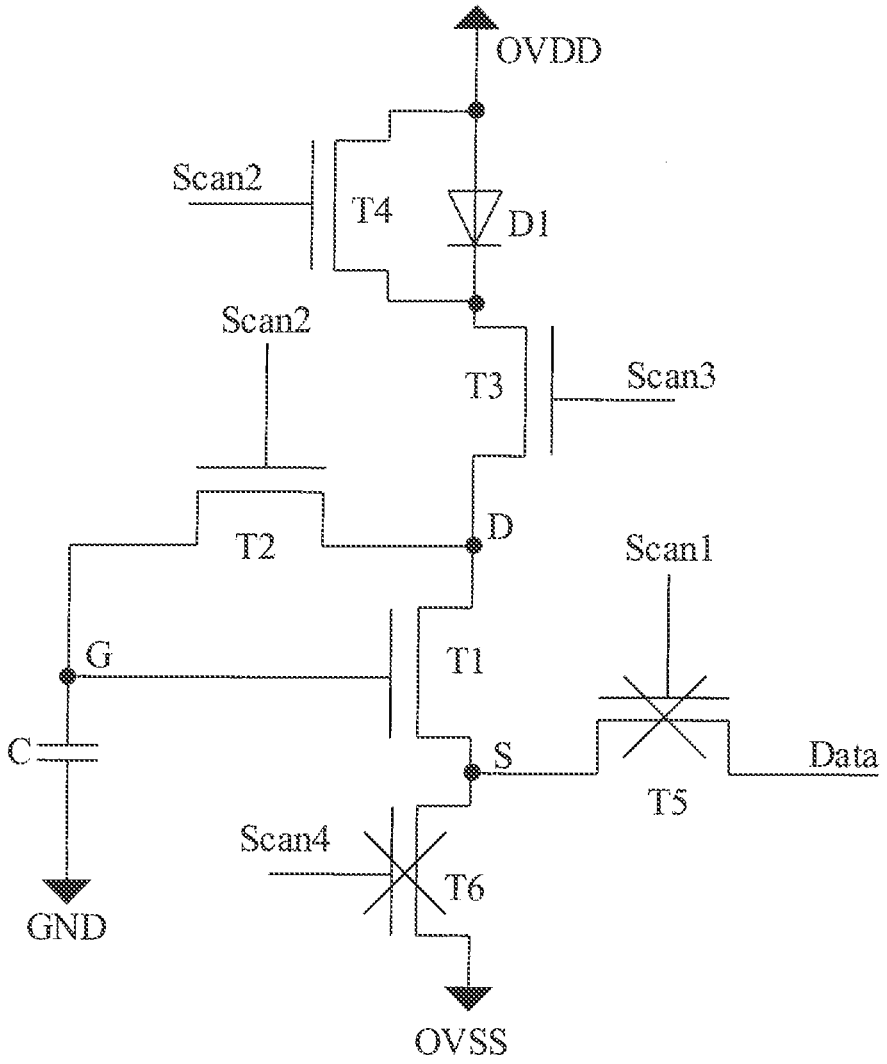
FIG. 4 illustrates step 2 in an AMOLED pixel driving method in accordance with the present disclosure.
Figure 5:
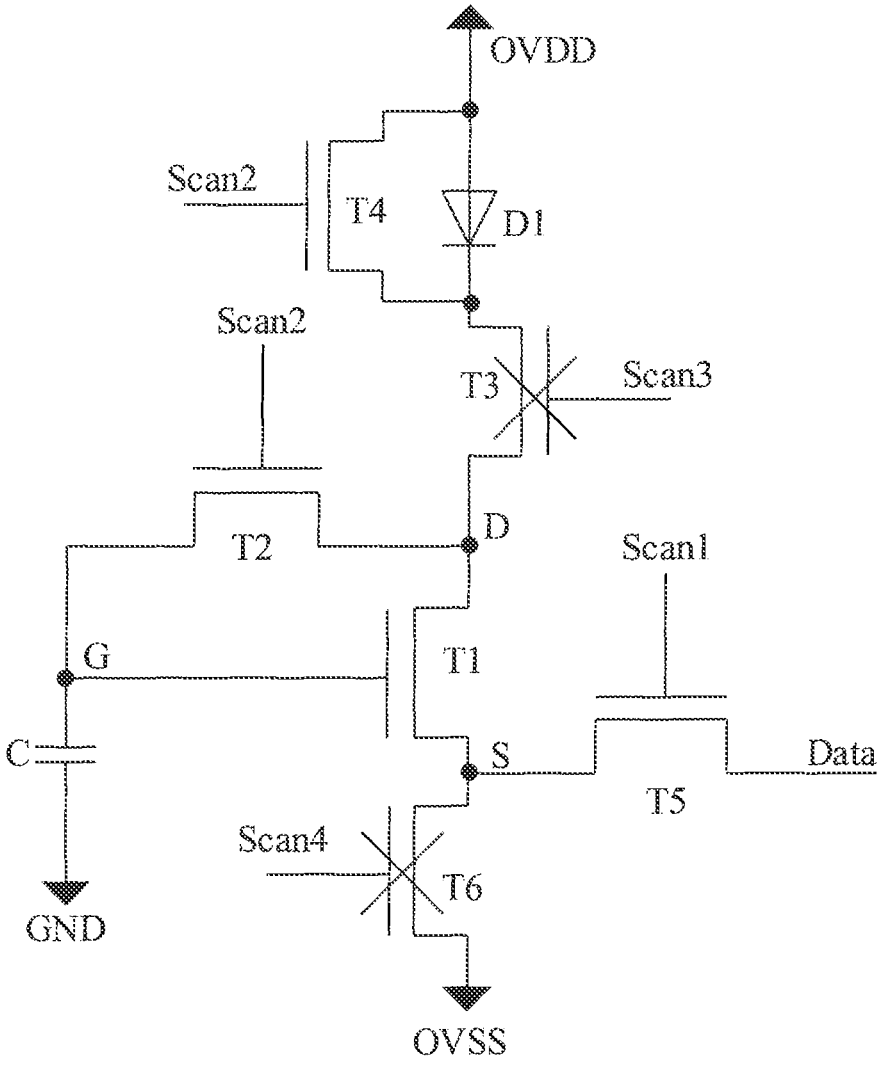
FIG. 5 illustrates step 6 in an AMOLED pixel driving method in accordance with the present disclosure.
Figure 6:
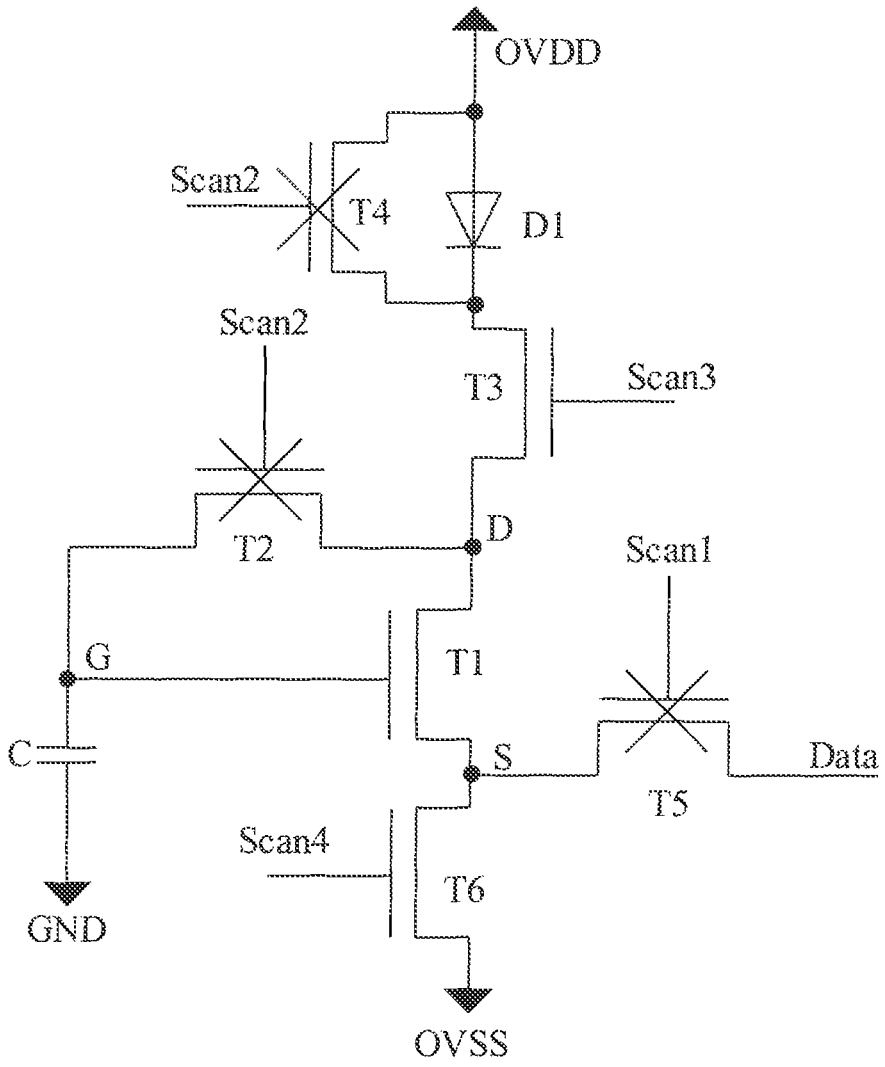
FIG. 6 illustrates step 4 in an AMOLED pixel driving method in accordance with the present disclosure.

Please refer to FIG. 4 to FIG. 6 in conjunction with FIG. 2 and FIG. 3. A working process of the AMOLED pixel driving circuit in accordance with the present disclosure is described as follows.

In the voltage initialization stage 1 as shown in FIG. 3 and FIG. 4, the second scanning signal Scan2 and the third scanning signal Scan3 provide high levels to control the second thin film transistor T2, the third thin film transistor T3, and the fourth thin film transistor T4 to be turned on. The first scanning signal Scan and the fourth scanning signal Scan4 provide low levels to control the fifth thin film transistor T5 and the sixth thin film transistor T6 to be turned off. The positive voltage OVDD of the power source is written to the first node G (i.e., the gate of the first thin film transistor T1) and stored in the capacitor C, and the organic light emitting diode D1 does not emit light. As such, a voltage initialization at the first node G (i.e., the gate of the first thin film transistor T1) is realized.

In the voltage storage stage 2 as shown in FIG. 3 and FIG. 5, the first scanning signal Scan1 and the second scanning signal Scan2 provide high levels to control the second thin film transistor T2, the fourth thin film transistor T4, and the fifth thin film transistor T5 to be turned on. The third scanning signal Scan3 and the fourth scanning signal Scan4 provide low levels to control the third thin film transistor T3 and the sixth thin film transistor T6 to be turned off. The data signal Data provides a display data voltage. Since the fifth thin film transistor T5 is turned on, the data signal Data is written to the second node S (i.e., the source of the first thin film transistor T1). The gate and the drain of the first thin film transistor T1 are short circuited by the second thin film transistor T2 that is turned on. A voltage of the first node G (i.e., the gate of the first thin film transistor T1) is continuously discharged via the source of the first thin film transistor until the voltage of the first node G (i.e., the gate of the first thin film transistor T1) is equal to a sum of the data signal Data and a threshold voltage Vth of the first thin film transistor T1. That is, Vg=Vs+Vth=Data+Vth. Vg is the voltage of the gate of the first thin film transistor T1. Vs is a voltage of the source of the first thin film transistor T1. Vth is the threshold voltage of the first thin film transistor T1. As such, the voltage of the gate of the first thin film transistor T1 is stored in the capacitor C, and the organic light emitting diode D1 does not emit light.

In the light emitting display stage 3 as shown in FIG. 3 and FIG. 6, the first scanning signal Scan1 and the second scanning signal Scan2 provide low levels to control the fifth thin film transistor T5, the fourth thin film transistor T4, and the second thin film transistor T2 to be turned off. The third scanning signal Scan3 and the fourth scanning signal Scan4 provide high levels to control the third thin film transistor T3 and the sixth thin film transistor T6 to be turned on. The voltage of the first node G (i.e., the gate of the first thin film transistor T1) is kept at the sum of the data signal Data and the threshold voltage Vth of the first thin film transistor T1 by the capacitor C. The negative voltage OVSS of the power source is written to the second node S (i.e., the source of the first thin film transistor T1) via the sixth thin film transistor T6 that is turned on. Vs=OVSS, that is, Vgs=Vg−Vs=Data+Vth−OVSS. The first thin film transistor T1 is turned on, and the organic light emitting diode D1 emits light.

Further, a current flowing through the organic light emitting diode D1 is:

$$I_{D1}=K(Vgs-Vth)^2. \quad (1)$$

$I_{D1}$ is the current flowing through the organic light emitting diode D1. The constant K is an intrinsic conductivity. Vgs is a voltage difference between the gate of the first thin film transistor and the source of the first thin film transistor.

The equation (1) is substituted by Vgs=Data+Vth−OVSS:

$$I_{D1}=K(Vgs-Vth)=K(\text{Data}+Vth-\text{OVSS}-Vth)^2=K(\text{Data}-\text{OVSS})^2.$$

This shows that the current $I_{D1}$ flowing through the organic light emitting diode D1 is not relevant to the threshold voltage Vth of the first thin film transistor T1 and a threshold voltage Vth of the organic light emitting diode D1. The current $I_{D1}$ is only relevant to the data signal Data and the negative voltage of the power source. As such, a drifting threshold voltage of a driving thin film transistor can be compensated. The problem that the current flowing through the organic light emitting diode is not stable because of the drifting threshold voltage can be solved. The effect of deterioration of the organic light emitting device on display brightness can be eliminated, and display uniformity of a panel can be increased.

Please refer to FIG. 4 to FIG. 6 in conjunction with FIG. 2 and FIG. 3. Based on the above-mentioned pixel driving circuit, the present disclosure further provides an AMOLED pixel driving method comprising the following steps.

In step 1, an AMOLED pixel driving circuit is provided. The AMOLED pixel driving circuit includes a first thin film transistor T1, a second thin film transistor T2, a third thin film transistor T3, a fourth thin film transistor T4, a fifth thin film transistor T5, a sixth thin film transistor T6, a capacitor C, and an organic light emitting diode D1.

A gate of the first thin film transistor T1 is electrically coupled to a first node G A source of the first thin film transistor T1 is electrically coupled to a second node S. A drain of the first thin film transistor T1 is electrically coupled to a second node D. A second scanning signal Scan2 is inputted to a gate of the second thin film transistor T2. A source of the second thin film transistor T2 is electrically coupled to the third node D. A drain of the second thin film transistor T2 is electrically coupled to the first node G A third scanning signal Scan3 is inputted to a gate of the third thin film transistor T3. A source of the third thin film transistor T3 is electrically coupled to a cathode of the organic light emitting diode D1. A drain of the third thin film transistor T3 is electrically coupled to the third node D. The second scanning signal Scan2 is inputted to a gate of the fourth thin film transistor T4. A positive voltage OVDD of a power source is inputted to a source of the fourth thin film transistor T4. A drain of the fourth thin film transistor T4 is electrically coupled to the cathode of the organic light emitting diode D1. A first scanning signal Scan1 is inputted to a gate of the fifth thin film transistor T5. A data signal Data is inputted to a source of the fifth thin film transistor T5. A drain of the fifth thin film transistor T5 is electrically coupled to the second node S. A fourth scanning signal Scan4 is inputted to a gate of the sixth thin film transistor T6. A negative voltage OVSS of the power source is inputted to a source of the sixth thin film transistor T6. A drain of the sixth thin film transistor T6 is electrically coupled to the second node S. One terminal of the capacitor C is electrically coupled to the first node G The other terminal of the capacitor C is electrically coupled to a ground G The positive voltage OVDD of the power source is inputted to an anode of the organic light emitting diode D1. The cathode of the organic light emitting diode D1 is electrically coupled to the drain of the fourth thin film transistor T4 and the source of the third thin film transistor T3.

The first scanning signal Scan1 controls the fifth thin film transistor T5 to be turned on or turned off. The second scanning signal Scan2 controls the second thin film transistor T2 and the fourth thin film transistor T4 to be turned on or turned off. The third scanning signal Scan3 controls the third thin film transistor T3 to be turned on or turned off. The fourth scanning signal Scan4 controls the sixth thin film transistor T6 to be turned on or turned off. The data signal Data is configured to control brightness of the organic light emitting diode D1. The capacitor C is a storage capacitor. Further, turning on the second thin film transistor T2 controls the first thin film transistor T1 to be a short circuit diode to compensate a threshold voltage. In the present embodiment, the organic light emitting diode D1 is a top-emitting organic light emitting diode. That is, the anode of the organic light emitting diode D1 is directly coupled to the positive voltage OVDD of the power source. Certainly, the organic light emitting diode D1 may be a bottom-emitting organic light emitting diode. That is, the cathode of the organic light emitting diode D1 is directly coupled to the negative voltage OVSS of the power source. Compared with the bottom-emitting light emitting diode, the top-emitting light emitting diode has a high aperture ratio and better performance.

In detail, the first thin film transistor T1, the second thin film transistor T2, the third thin film transistor T3, the fourth thin film transistor T4, the fifth thin film transistor T5, and the sixth thin film transistor T6 may be low temperature poly-silicon thin film transistors, oxide semiconductor thin film transistors, or amorphous silicon thin film transistors. In the present preferred embodiment, the above-mentioned six thin film transistors are N-type thin film transistors to facilitate the structure of the circuit.

In detail, the first scanning signal Scan1, the second scanning signal Scan2, the third scanning signal Scan3, and the fourth scanning signal Scan4 are provided by an external timing controller.

FIG. 3 illustrates a timing diagram of the scanning signals in the pixel driving circuit in accordance with an embodiment of the present disclosure. Please refer to FIG. 2 and FIG. 3. The first scanning signal Scan1, the second scanning signal Scan2, the third scanning signal Scan3, and the fourth scanning signal Scan4 are combined to correspond to a voltage initialization stage 1, a voltage storage stage 2, and a light emitting display stage 3.

In step 2, the voltage initialization stage 1 is performed. In the voltage initialization stage 1 as shown in FIG. 3 and FIG. 4, the second scanning signal Scan2 and the third scanning signal Scan3 provide high levels to control the second thin film transistor T2, the third thin film transistor T3, and the fourth thin film transistor T4 to be turned on. The first scanning signal Scan and the fourth scanning signal Scan4 provide low levels to control the fifth thin film transistor T5 and the sixth thin film transistor T6 to be turned off. The positive voltage OVDD of the power source is written to the first node G (i.e., the gate of the first thin film transistor T1) and stored in the capacitor C, and the organic light emitting diode D1 does not emit light. As such, a voltage initialization at the first node G (i.e., the gate of the first thin film transistor T1) is realized.

In step 3, the voltage storage stage 2 is performed. In the voltage storage stage 2 as shown in FIG. 3 and FIG. 5, the first scanning signal Scan1 and the second scanning signal Scan2 provide high levels to control the second thin film transistor T2, the fourth thin film transistor T4, and the fifth thin film transistor T5 to be turned on. The third scanning signal Scan3 and the fourth scanning signal Scan4 provide low levels to control the third thin film transistor T3 and the sixth thin film transistor T6 to be turned off. The data signal Data provides a display data voltage. Since the fifth thin film transistor T5 is turned on, the data signal Data is written to the second node S (i.e., the source of the first thin film transistor T1). The gate and the drain of the first thin film transistor T1 are short circuited by the second thin film transistor T2 that is turned on. A voltage of the first node G (i.e., the gate of the first thin film transistor T1) is continuously discharged via the source of the first thin film transistor until the voltage of the first node G (i.e., the gate of the first thin film transistor T1) is equal to a sum of the data signal Data and a threshold voltage Vth of the first thin film transistor T1. That is, Vg=Vs+Vth=Data+Vth. Vg is the voltage of the gate of the first thin film transistor T1. Vs is a voltage of the source of the first thin film transistor T1. Vth is the threshold voltage of the first thin film transistor T1. As such, the voltage of the gate of the first thin film transistor T1 is stored in the capacitor C, and the organic light emitting diode D1 does not emit light.

In step 4, the light emitting display stage 3 is performed. In the light emitting display stage 3 as shown in FIG. 3 and FIG. 6, the first scanning signal Scan1 and the second scanning signal Scan2 provide low levels to control the fifth thin film transistor T5, the fourth thin film transistor T4, and the second thin film transistor T2 to be turned off. The third scanning signal Scan3 and the fourth scanning signal Scan4 provide high levels to control the third thin film transistor T3 and the sixth thin film transistor T6 to be turned on. The voltage of the first node G (i.e., the gate of the first thin film transistor T1) is kept at the sum of the data signal Data and the threshold voltage Vth of the first thin film transistor T1 by the capacitor C. The negative voltage OVSS of the power source is written to the second node S (i.e., the source of the first thin film transistor T1) via the sixth thin film transistor T6 that is turned on. Vs=OVSS, that is, Vgs=Vg−Vs=Data+Vth−OVSS. The first thin film transistor T1 is turned on, and the organic light emitting diode D1 emits light.

Further, a current flowing through the organic light emitting diode D1 is:

$$I_{D1}=K(Vgs-Vth)^2. \quad (1)$$

$I_{D1}$ is the current flowing through the organic light emitting diode D1. The constant K is an intrinsic conductivity. Vgs is a voltage difference between the gate of the first thin film transistor and the source of the first thin film transistor.

The equation (1) is substituted by Vgs=Data+Vth-OVSS:

$$I_{D1}=K(Vgs-Vth)^2=K(\text{Data}+Vth-\text{OVSS}-Vth)^2=K(\text{Data}-\text{OVSS})^2.$$

This shows that the current $I_{D1}$ flowing through the organic light emitting diode D1 is not relevant to the threshold voltage Vth of the first thin film transistor T1 and a threshold voltage Vth of the organic light emitting diode D1. The current $I_{D1}$ is only relevant to the data signal Data and the negative voltage of the power source. As such, a drifting threshold voltage of a driving thin film transistor can be compensated. The problem that the current flowing through the organic light emitting diode is not stable because of the drifting threshold voltage can be solved. The effect of deterioration of the organic light emitting device on display brightness can be eliminated, and display uniformity of a panel can be increased.

In brief, the AMOLED pixel driving circuit and the AMOLED pixel driving method provided by the present disclosure utilizes the 6T1C circuit in conjunction with a simple driving timing. An extra power source is not required, and control signals are fewer. As such, the threshold voltage of the driving transistor can be effectively compensated, so that the current flowing through the organic light emitting device is not affected by the threshold voltage. Effect of deterioration of the organic light emitting device on display brightness can be eliminated, and display uniformity of a panel can be increased. Furthermore, the structure of the AMOLED pixel driving circuit is simplified, and cost is decreased significantly.

The above description is merely the specific embodiments of the present disclosure, but the protection scope of the present disclosure is not limited thereto, any skilled who is familiar with this art could readily conceive variations or substitutions within the disclosed technical scope disclosed by the present disclosure, and these variations or substitutions shall be encompassed in the protection scope of the present disclosure. Thus, the protection scope of the present disclosure shall be subjected to the protection scope of the claims.

What is claimed is:

1. An AMOLED pixel driving circuit, comprising:

a first thin film transistor, a second thin film transistor, a third thin film transistor, a fourth thin film transistor, a fifth thin film transistor, a sixth thin film transistor, a capacitor, and an organic light emitting diode, wherein a gate of the first thin film transistor is electrically coupled to a first node, a source of the first thin film transistor is electrically coupled to a second node, and a drain of the first thin film transistor is electrically coupled to a second node;

a second scanning signal is inputted to a gate of the second thin film transistor, a source of the second thin film transistor is electrically coupled to the third node, and a drain of the second thin film transistor is electrically coupled to the first node;

a third scanning signal is inputted to a gate of the third thin film transistor, a source of the third thin film transistor is electrically coupled to a cathode of the organic light emitting diode, and a drain of the third thin film transistor is electrically coupled to the third node;

the second scanning signal is inputted to a gate of the fourth thin film transistor, a positive voltage of a power source is inputted to a source of the fourth thin film transistor, and a drain of the fourth thin film transistor is electrically coupled to the cathode of the organic light emitting diode;

a first scanning signal is inputted to a gate of the fifth thin film transistor, a data signal is inputted to a source of the fifth thin film transistor, and a drain of the fifth thin film transistor is electrically coupled to the second node;

a fourth scanning signal is inputted to a gate of the sixth thin film transistor, a negative voltage of the power source is inputted to a source of the sixth thin film transistor, and a drain of the sixth thin film transistor is electrically coupled to the second node;

one terminal of the capacitor is electrically coupled to the first node, and the other terminal of the capacitor is electrically coupled to a ground;

the positive voltage of the power source is inputted to an anode of the organic light emitting diode, and the cathode of the organic light emitting diode is electrically coupled to the drain of the fourth thin film transistor and the source of the third thin film transistor;

the first scanning signal, the second scanning signal, the third scanning signal, and the fourth scanning signal are provided by an external timing controller;

the first scanning signal, the second scanning signal, the third scanning signal, and the fourth scanning signal are combined to correspond to a voltage initialization stage, a voltage storage stage, and a light emitting display stage.

2. The AMOLED pixel driving circuit of claim 1, wherein the first thin film transistor, the second thin film transistor, the third thin film transistor, the fourth thin film transistor, the fifth thin film transistor, and the sixth thin film transistor are low temperature poly-silicon thin film transistors, oxide semiconductor thin film transistors, or amorphous silicon thin film transistors.

3. The AMOLED pixel driving circuit of claim 1, wherein the first thin film transistor, the second thin film transistor, the third thin film transistor, the fourth thin film transistor, the fifth thin film transistor, and the sixth thin film transistor are N-type thin film transistors, in the voltage initialization stage, the first scanning signal provides a low level, the second scanning signal provides a high level, the third scanning signal provides a high level, and the fourth scanning signal provides a low level;

in the voltage storage stage, the first scanning signal provides a high level, the second scanning signal provides a high level, the third scanning signal provides a low level, and the fourth scanning signal provides a low level;

in the light emitting display stage, the first scanning signal provides a low level, the second scanning signal provides a low level, the third scanning signal provides a high level, and the fourth scanning signal provides a high level.

4. An AMOLED pixel driving circuit, comprising:

a first thin film transistor, a second thin film transistor, a third thin film transistor, a fourth thin film transistor, a fifth thin film transistor, a sixth thin film transistor, a capacitor, and an organic light emitting diode, wherein a gate of the first thin film transistor is electrically coupled to a first node, a source of the first thin film transistor is electrically coupled to a second node, and a drain of the first thin film transistor is electrically coupled to a second node;

a second scanning signal is inputted to a gate of the second thin film transistor, a source of the second thin film transistor is electrically coupled to the third node, and a drain of the second thin film transistor is electrically coupled to the first node;

a third scanning signal is inputted to a gate of the third thin film transistor, a source of the third thin film transistor is electrically coupled to a cathode of the organic light emitting diode, and a drain of the third thin film transistor is electrically coupled to the third node;

the second scanning signal is inputted to a gate of the fourth thin film transistor, a positive voltage of a power source is inputted to a source of the fourth thin film transistor, and a drain of the fourth thin film transistor is electrically coupled to the cathode of the organic light emitting diode;

a first scanning signal is inputted to a gate of the fifth thin film transistor, a data signal is inputted to a source of the fifth thin film transistor, and a drain of the fifth thin film transistor is electrically coupled to the second node;

a fourth scanning signal is inputted to a gate of the sixth thin film transistor, a negative voltage of the power source is inputted to a source of the sixth thin film transistor, and a drain of the sixth thin film transistor is electrically coupled to the second node;

one terminal of the capacitor is electrically coupled to the first node, and the other terminal of the capacitor is electrically coupled to a ground;

the positive voltage of the power source is inputted to an anode of the organic light emitting diode, and the cathode of the organic light emitting diode is electrically coupled to the drain of the fourth thin film transistor and the source of the third thin film transistor.

5. The AMOLED pixel driving circuit of claim 4, wherein the first scanning signal, the second scanning signal, the third scanning signal, and the fourth scanning signal are provided by an external timing controller.

6. The AMOLED pixel driving circuit of claim 4, wherein the first thin film transistor, the second thin film transistor, the third thin film transistor, the fourth thin film transistor, the fifth thin film transistor, and the sixth thin film transistor are low temperature poly-silicon thin film transistors, oxide semiconductor thin film transistors, or amorphous silicon thin film transistors.

7. The AMOLED pixel driving circuit of claim 1, wherein the first scanning signal, the second scanning signal, the third scanning signal, and the fourth scanning signal are combined to correspond to a voltage initialization stage, a voltage storage stage, and a light emitting display stage.

8. The AMOLED pixel driving circuit of claim 7, wherein the first thin film transistor, the second thin film transistor, the third thin film transistor, the fourth thin film transistor, the fifth thin film transistor, and the sixth thin film transistor are N-type thin film transistors, in the voltage initialization stage, the first scanning signal provides a low level, the second scanning signal provides a high level, the third scanning signal provides a high level, and the fourth scanning signal provides a low level;

in the voltage storage stage, the first scanning signal provides a high level, the second scanning signal provides a high level, the third scanning signal provides a low level, and the fourth scanning signal provides a low level;

in the light emitting display stage, the first scanning signal provides a low level, the second scanning signal provides a low level, the third scanning signal provides a high level, and the fourth scanning signal provides a high level.

9. An AMOLED pixel driving method, comprising:

in step 1, providing an AMOLED pixel driving circuit, wherein the AMOLED pixel driving circuit comprises a first thin film transistor, a second thin film transistor, a third thin film transistor, a fourth thin film transistor, a fifth thin film transistor, a sixth thin film transistor, a capacitor, and an organic light emitting diode, a gate of the first thin film transistor is electrically coupled to a first node, a source of the first thin film transistor is electrically coupled to a second node, and a drain of the first thin film transistor is electrically coupled to a second node;

a second scanning signal is inputted to a gate of the second thin film transistor, a source of the second thin film transistor is electrically coupled to the third node, and a drain of the second thin film transistor is electrically coupled to the first node;

a third scanning signal is inputted to a gate of the third thin film transistor, a source of the third thin film transistor is electrically coupled to a cathode of the organic light emitting diode, and a drain of the third thin film transistor is electrically coupled to the third node;

the second scanning signal is inputted to a gate of the fourth thin film transistor, a positive voltage of a power source is inputted to a source of the fourth thin film transistor, and a drain of the fourth thin film transistor is electrically coupled to the cathode of the organic light emitting diode;

a first scanning signal is inputted to a gate of the fifth thin film transistor, a data signal is inputted to a source of the fifth thin film transistor, and a drain of the fifth thin film transistor is electrically coupled to the second node;

a fourth scanning signal is inputted to a gate of the sixth thin film transistor, a negative voltage of the power source is inputted to a source of the sixth thin film transistor, and a drain of the sixth thin film transistor is electrically coupled to the second node;

one terminal of the capacitor is electrically coupled to the first node, and the other terminal of the capacitor is electrically coupled to a ground;

the positive voltage of the power source is inputted to an anode of the organic light emitting diode, and the cathode of the organic light emitting diode is electrically coupled to the drain of the fourth thin film transistor and the source of the third thin film transistor;

in step 2, performing a voltage initialization stage, wherein the first scanning signal controls the fifth thin film transistor to be turned off, the second scanning signal controls the second thin film transistor and the fourth thin film transistor to be turned on, the third scanning signal controls the third thin film transistor to be turned on, the fourth scanning signal controls the sixth thin film transistor to be turned off, the positive voltage of the power source is written to the first node and stored in the capacitor, and the organic light emitting diode does not emit;

in step 3, performing a voltage storage stage, wherein the first scanning signal controls the fifth thin film transistor to be turned on, the second scanning signal controls the second thin film transistor and the fourth thin film transistor to be turned on, the third scanning signal controls the third thin film transistor to be turned off, the fourth scanning signal controls the sixth thin film transistor to be turned off, the data signal provides a display data voltage, the data signal is written to the second node, the capacitor is discharged, so that a voltage of the first node is equal to a sum of a voltage of the second node and a threshold voltage of the first thin film transistor, the voltage of the first node is stored in the capacitor, and the organic light emitting diode does not emit;

in step 4, performing a light emitting display stage, wherein the first scanning signal controls the fifth thin film transistor to be turned off, the second scanning signal controls the second thin film transistor and the fourth thin film transistor to be turned off, the third scanning signal controls the third thin film transistor to be turned on, the fourth scanning signal controls the sixth thin film transistor to be turned on, the voltage of the first node is kept at a sum of the data signal and the threshold voltage of the first thin film transistor by the capacitor, the negative voltage of the power source is written to the second node, the first thin film transistor is turned on, the organic light emitting diode emits light, and a current flowing through the organic light emitting diode is relevant to the threshold voltage of the first thin film transistor.

10. The AMOLED pixel driving method of claim 9, wherein the first scanning signal, the second scanning signal, the third scanning signal, and the fourth scanning signal are provided by an external timing controller.

11. The AMOLED pixel driving method of claim 9, wherein the first thin film transistor, the second thin film transistor, the third thin film transistor, the fourth thin film transistor, the fifth thin film transistor, and the sixth thin film transistor are N-type thin film transistors.

12. The AMOLED pixel driving method of claim 9, wherein the first thin film transistor, the second thin film transistor, the third thin film transistor, the fourth thin film transistor, the fifth thin film transistor, and the sixth thin film transistor are N-type thin film transistors, in the voltage initialization stage, the first scanning signal provides a low level, the second scanning signal provides a high level, the third scanning signal provides a high level, and the fourth scanning signal provides a low level;

in the voltage storage stage, the first scanning signal provides a high level, the second scanning signal provides a high level, the third scanning signal provides a low level, and the fourth scanning signal provides a low level;

in the light emitting display stage, the first scanning signal provides a low level, the second scanning signal provides a low level, the third scanning signal provides a high level, and the fourth scanning signal provides a high level.

* * * * *